US008925363B2

(12) United States Patent
Charles

(10) Patent No.: US 8,925,363 B2
(45) Date of Patent: Jan. 6, 2015

(54) SPLIT IDLE STATION ASSEMBLIES FOR TRANSFER PRESS ASSEMBLIES

(71) Applicant: Toyota Motor Engineering & Manufacturing North America, Inc., Erlanger, KY (US)

(72) Inventor: Thoney R. Charles, Georgetown, KY (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 181 days.

(21) Appl. No.: 13/653,502

(22) Filed: Oct. 17, 2012

(65) Prior Publication Data

US 2014/0102165 A1 Apr. 17, 2014

(51) Int. Cl.
*B65G 25/00* (2006.01)
*B21D 43/04* (2006.01)

(52) U.S. Cl.
USPC ..... 72/405.09; 72/405.11; 72/405.13; 198/621.1; 100/216

(58) Field of Classification Search
CPC ..... B21D 43/00; B21D 43/04; B21D 43/055
USPC ..... 72/405.05, 405.09, 405.11, 405.13, 72/405.16; 198/621, 621.1; 100/216
See application file for complete search history.

(56) References Cited

U.S. PATENT DOCUMENTS

| | | | | |
|---|---|---|---|---|
| 4,393,682 | A | 7/1983 | Imanishi | |
| 4,511,029 | A | 4/1985 | Okawa | |
| 4,852,381 | A * | 8/1989 | Sofy | 72/405.13 |
| 4,895,013 | A * | 1/1990 | Sofy | 72/405.13 |
| 6,073,551 | A | 6/2000 | Dangelmayr et al. | |
| 6,220,813 | B1 | 4/2001 | Launiere | |
| 6,622,850 | B2 | 9/2003 | Noda | |
| 7,007,538 | B2 * | 3/2006 | Sofy | 72/405.16 |
| 7,690,238 | B2 * | 4/2010 | Shiroza | 72/405.11 |
| 7,721,584 | B2 * | 5/2010 | Tokunaga et al. | 72/405.09 |
| 7,802,460 | B2 * | 9/2010 | Tokunaga et al. | 72/405.09 |

* cited by examiner

*Primary Examiner* — David B Jones
(74) *Attorney, Agent, or Firm* — Dinsmore & Shohl LLP

(57) ABSTRACT

A split idle station assembly for a transfer press assembly includes a track assembly, a first base assembly slidably connected to the track assembly and a second base assembly slidably connected to the track assembly. The first and second base assemblies have a support configuration with the first base assembly adjacent the second base assembly forming a work piece support assembly for supporting a work piece thereon between work stations of the transfer press assembly. The first and second base assemblies have a split configuration where the first base assembly is moved apart from the second base assembly along the track assembly.

14 Claims, 9 Drawing Sheets

SPLIT IDLE STATION ASSEMBLIES FOR TRANSFER PRESS ASSEMBLIES

TECHNICAL FIELD

The present specification generally relates to transfer press assemblies and, more particularly, to a split idle station assembly for a transfer press assembly.

BACKGROUND

Transfer press assemblies are often used in various manufacturing industries, such as automotive and appliance industries, due to the relatively large volume of parts that can be produced in a progressive, automated fashion. Multiple die stations are often provided, where a blank is delivered to each of the dies stations in successive fashion for a forming operation. The part is often delivered to each of the die stations using a transfer feeder assembly. Transfer feeder bars of the transfer feeder assembly move along an axis for moving the parts from one die station to the next.

Often times, idle stations are provided between the die stations. The idle stations may be incorporated, not to perform work on the part, but to provide locating and positioning functions between the die stations. Idle stations can also provide a rest location for the part, as opposed to continuous movement and working of the part.

Because parts may be different sizes and/or shapes, it may be necessary to provide the idle stations with multiple configurations to accurately support, position and locate the parts located thereon. Accordingly, idle stations that facilitate changes between various configurations in an ergonomic fashion to accommodate different sized and shaped parts are desired.

SUMMARY

In one embodiment, a split idle station assembly for a transfer press assembly includes a track assembly, a first base assembly slidably connected to the track assembly and a second base assembly slidably connected to the track assembly. The first and second base assemblies have a support configuration with the first base assembly adjacent the second base assembly forming a work piece support assembly for supporting a work piece thereon between work stations of the transfer press assembly. The first and second base assemblies have a split configuration where the first base assembly is moved apart from the second base assembly along the track assembly.

In another embodiment, a transfer press assembly includes a first work station, a second work station and a transfer feed assembly that transfers a work piece from the first work station to the second work station. A split idle station assembly is located between the first work station and the second work station. The split idle station assembly includes a track assembly, a first base assembly slidably connected to the track assembly and a second base assembly slidably connected to the track assembly. The first and second base assemblies have a support configuration with the first base assembly adjacent the second base assembly forming a work piece support assembly for supporting a work piece thereon between work stations of the transfer press assembly. The first and second base assemblies have a split configuration where the first base assembly is moved apart from the second base assembly along the track assembly.

In another embodiment, a method of providing an idle station for a work piece between work stations of a transfer press assembly is provided. The method includes moving first and second base assemblies along a track assembly to a support configuration with the first base assembly adjacent the second base assembly forming a work piece support assembly for supporting a work piece thereon between the work stations of the transfer press assembly. The first and second base assemblies are moved along the track assembly to a split configuration where the first base assembly is moved apart from the second base assembly along the track assembly.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments described herein generally relate to split idle station assemblies for transfer press assemblies. The split idle station assemblies may be located between work stations of the transfer press assemblies where no work operation is performed on a work piece travelling through the transfer press assemblies. The split idle station assemblies include first and second support assemblies that are movably attached to a track such that the first and second support assemblies can move toward each other to a support configuration and away from each other to a split configuration along the track.

Figure 1:
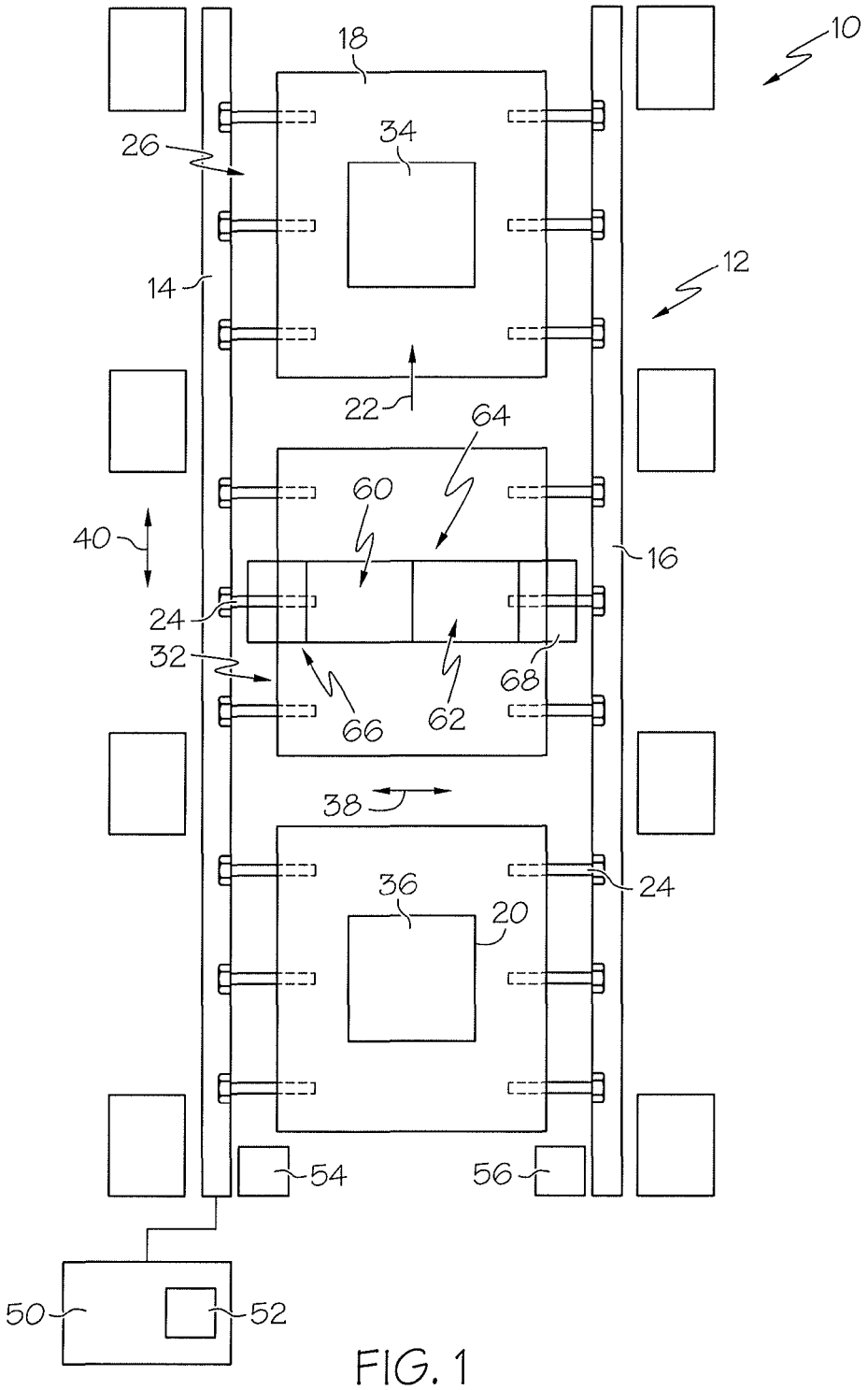
FIG. 1 is a schematic illustration of a transfer press assembly including a split idle station assembly according to one or more embodiments described herein.

Referring to FIG. 1, a transfer press assembly 10 includes a transfer feed assembly 12 including transfer feed bars 14 and 16 located at opposite sides of a plurality of work stations 18 and 20. The transfer feed bars 14 and 16 are substantially parallel to define a feed direction 22 through the transfer press assembly 10. Each transfer feed bar 14 and 16 includes a plurality of fingers 24. The fingers 24 of the feed bar 14 and the fingers 24 of the feed bar 16 extend toward each other and into a transfer region 26 of the transfer press assembly 10 through which a work piece is conveyed in the feed direction 22. As will be described below, the fingers 24 and the transfer feed bars 14 and 16 are used to move work pieces between work stations during a forming process.

The transfer press assembly 10 includes two work stations 28 and 30 and a split idle station assembly 32 located between the two work stations 28 and 30 and within the transfer region 26. The work stations 28 are used to form the work piece and may include one or more in-line presses 34 and 36. The presses 34 and 36 can perform various portions of an overall forming process, such as drawing, trimming, bending, piercing, stamping and the like. Additionally, while only two work stations 28 and 30 and one split idle station assembly 32 are shown for illustrative purposes, any number of work stations can be employed with idle stations between any number of adjacent work stations.

The feed transfer assembly 12 is used to transfer the work pieces from one work station 28 to the split idle station assembly 32 and then to the second work station 30, and so on. Two or more types of transfer motion may be used by the transfer feed bars 14 and 16. In some embodiments, the transfer motion of the transfer feed bars 14 and 16 may include engagement motion in the direction of arrow 38, into and away from the transfer region 26. This motion can allow the fingers 24 to be inserted or otherwise engage the work pieces for a transfer operation. In some embodiments, the fingers 24 may utilize clamps or other engaging structures to engage the work pieces. The transfer motion of the feed bars 14 and 16 may also include an indexing motion in the direction of arrow 40, to and from work stations 28 and 30 in the transfer or conveying direction. This motion can allow for the transfer of the work piece, once engaged by the fingers 24, from work station 28 to the split idle station assembly 32 and from the split idle station assembly 32 to the work station 30. As can be seen, the indexing motion may be substantially perpendicular to the engagement motion. The transfer motion of the feed bars 14 and 16 may also include a lifting motion in the direction of arrow 42, up and down. This motion can allow for raising and lowering of the work piece, once engaged by the fingers 24. Thus, the transfer feed bars 14 and 16 may be capable of dual-axis or tri-axis motion. Various other motions may be possible, depending on the transfer requirements.

Movement of the feed bars 14 and 16 may be controlled using a feed control system 50. For example, the feed control system 50 may include a computer 52 having logic for controlling operation of various transfer actuators 54 and 56 (e.g., motors). The transfer actuators 54 and 56, which may include multiple transfer actuators for the transfer, indexing and lifting motions, may be used to move the transfer feed bars 16 for moving the work pieces. In some embodiments, the computer 52 may be used to control operation of the presses 34 and 36, whose operation may be coordinated with operation of the actuators 54 and 56.

The split idle station assembly 32 is located between the work stations 28 and 30 and is sized and located to receive a work piece between working operations. The split idle station assembly 32 includes a first base assembly 60 and a second base assembly 62 that together form a work piece support assembly 64 for supporting the work piece thereon. The first base assembly 60 and the second base assembly 62 are both movably mounted to a track assembly 66 including a track 68 (e.g., a rail) that allows movement of the first and second base assemblies 60 and 62 toward and away from each other between the support and split configurations.

Figure 2:
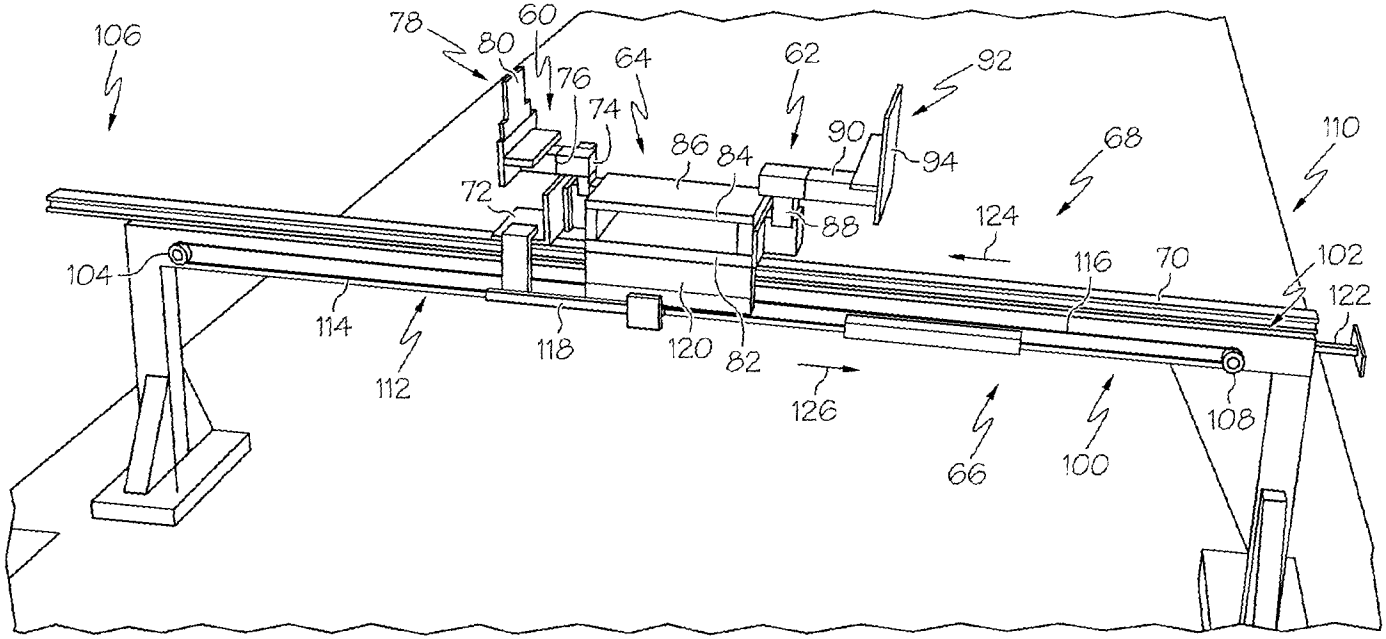
FIG. 2 is a perspective view of the split idle station assembly of FIG. 1 in a support configuration according to one or more embodiments described herein.

Referring to FIG. 2, the split idle station assembly 32 includes the track assembly 66 that supports the first base assembly 60 and the second base assembly 62 thereon. In some embodiments, the track 68 may include a rail 70 that is slidably received by the first and second base assemblies 60 and 62. Bearings, wheels or any other suitable features may be used by the first and second base assemblies 60 and 62 and/or the track assembly 66 to facilitate sliding movement of the first and second base assemblies 60 and 62 along a length of the rail 70.

FIG. 2 illustrates the split idle station assembly 32 in the support configuration with the first base assembly 60 adjacent the second base assembly 62 thereby forming the work piece support assembly 64 for supporting the work piece thereon. The first base assembly 60 includes a track support 72 that rides along the rail 70 horizontally or side-to-side (e.g., substantially transverse to the feed direction 22 (FIG. 1)) in a sliding fashion and an upwardly extending support arm 74 that extends upwardly from the track support 72. A sideways extending support arm 76 may extend outwardly from the upwardly extending support arm 74. A work piece support 78 may be supported in an upright position by the upwardly extending support arm 76. In the illustrated embodiment, the work piece support 78 includes a plate 80 that faces the second base assembly 62. As will be described in greater detail below, the work piece support 78 and plate 80 may be used to support and/or align the work piece at the split idle station assembly 32.

The second base assembly 62 includes a track support 82 that rides along the rail 70 side-to-side in a sliding fashion. The track support 82 includes a support member 84 having a support surface 86 that can support the work piece thereon. In the illustrated embodiment, the support surface 86 is substantially planar (e.g., to support a somewhat planar or sheet-like work piece). However, any suitable shape or profile for the support surface can be used, such as non-planar profiles. As one example, the support surface may be formed to nest with the work piece. Thus, a variety of shapes and/or profiles can be used for the support surface. An upwardly extending support arm 88 extends upwardly from the track support 82. A sideways extending support arm 90 may extend outwardly from the upwardly extending support arm 88. A work piece support 92 may be supported in an upright position by the upwardly support arm 88. In the illustrated embodiment, the work piece support 92 includes a plate 94 that faces the first base assembly 60. The work piece support 92 and plate 94 may cooperate with the work piece support 78, plate 80 and the support surface 86 to support and/or align the work piece at the split idle station assembly 32.

Figure 3:
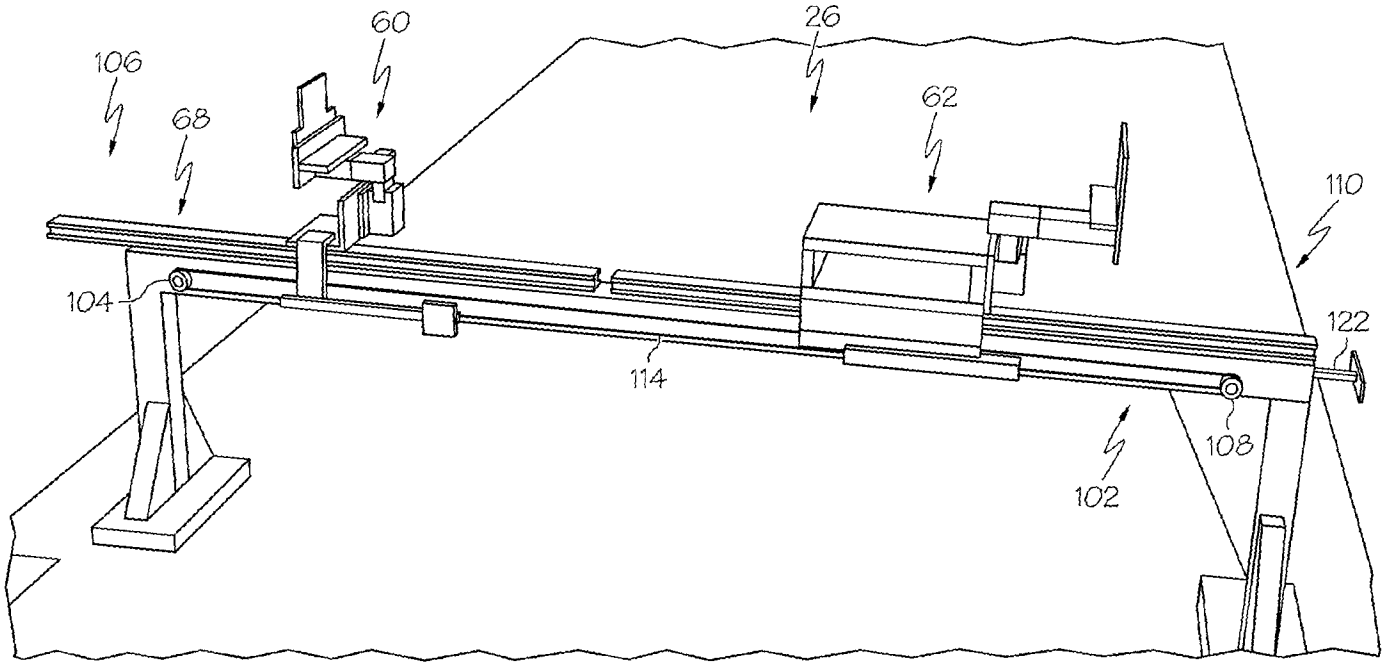
FIG. 3 is a perspective view of the split idle station assembly of FIG. 2 in a split configuration.

The first base assembly 60 and the second base assembly 62 are connected to a drive assembly 100. The drive assembly 100 may be used to move the first base assembly 60 and the second base assembly 62 toward and away from each other between the support configuration, shown by FIG. 2, and the split configuration, shown by FIG. 3. The drive assembly 100, in the illustrated embodiment, includes a pulley system 102 including pulley 104 located at a first base assembly side 106 of the track 68 and a pulley 108 located at a second base assembly side 110 of the track 68. A continuous belt or cable 112 may be trained around the pulleys 104 and 108. The cable 112 may include a first leg 114 and a second leg 116. The first leg 114 may be connected to a cable connect arm 118 of the first base assembly 60 and the second leg 116 may be connected to a cable connect arm 120 of the second base assembly 62. A moveable handle 122 may be connected to the second base assembly 62. In other embodiments a moveable handle may be connected to the first base assembly 60. The moveable handle 122 can be used to slide the second base assembly 62 along the track 68. Because the second base assembly 62 is connected to the second leg 116 of the cable 112, the cable 112 moves about the pulleys 104 and 108. When moving the first base assembly 60 and the second base assembly 62 toward each other to the support configuration, the operator may grasp the moveable handle 122 and push the second base assembly 62 toward the first base assembly 60. Such movement of the second base assembly 62 causes the second leg 116 to move in the direction of arrow 124 due to the connection between the cable connect arm 120 of the second base assembly 62. Such movement of the second base assembly 62 also causes simultaneous movement of the first leg 114 in the direction of arrow 126, opposite the direction of arrow 124. Such movement of the first leg 114 causes the first base assembly 60 to move toward the second base assembly 62 due to the connection between the first leg 114 and the cable connect arm 118 of the first base assembly 60.

While movement of the first base assembly 60 and the second base assembly 62 toward each other provides the support configuration of FIG. 2, movement of the first base assembly 60 and the second base assembly 62 away from each other provides a split configuration (FIG. 3) that can position the first base assembly 60 apart from each other and near respective sides 106 and 110 of the transfer region 26. Such positioning of the first base assembly 60 near the side 106 and the second base assembly 62 near side 110 can allow for greater access by the operator of each of the first base assembly 60 and the second base assembly 62.

Figure 4:
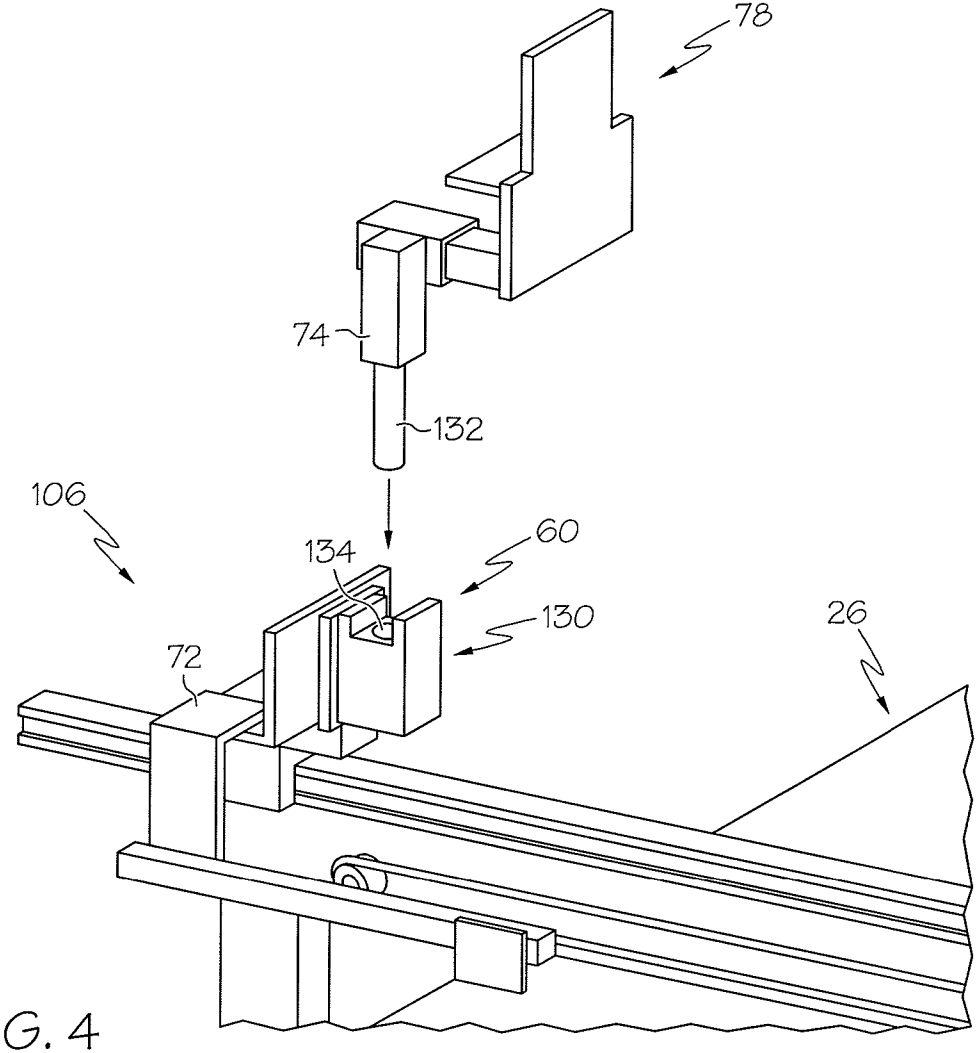
FIG. 4 is a perspective view of a base assembly for use in the split idle station assembly of FIG. 2 according to one or more embodiments described herein.
Figure 5:
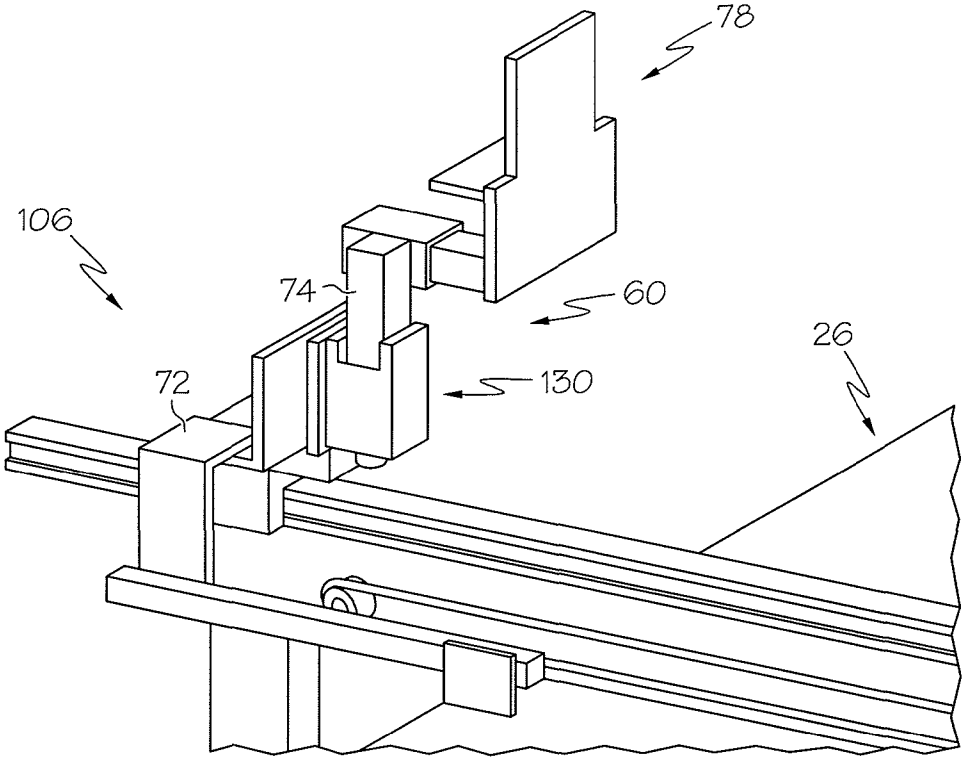
FIG. 5 is another perspective view of the base assembly of FIG. 4.

Referring to FIGS. 4 and 5, the first base assembly 60 is illustrated in its split configuration, near the side 106 of the transfer region 26. As can be seen, the first base assembly 60 may include the upwardly extending support arm 74 which, in this embodiment, is removable from the track support 72. Such a removable arrangement can allow for interchangeability of the work piece support 78 with other work piece supports of other sizes and shapes (e.g., to accommodate work pieces of varying sized and shapes). A removable connection structure 130 may be provided that allows the upward extending support arm 74 to separate from the track support 72. In some embodiments, the removable connection structure 130 may include a pin portion 132 and a slot portion 134 that is sized to receive the pin portion 132 for a mating connection. Any suitable other connection structures may be used.

Figure 6:
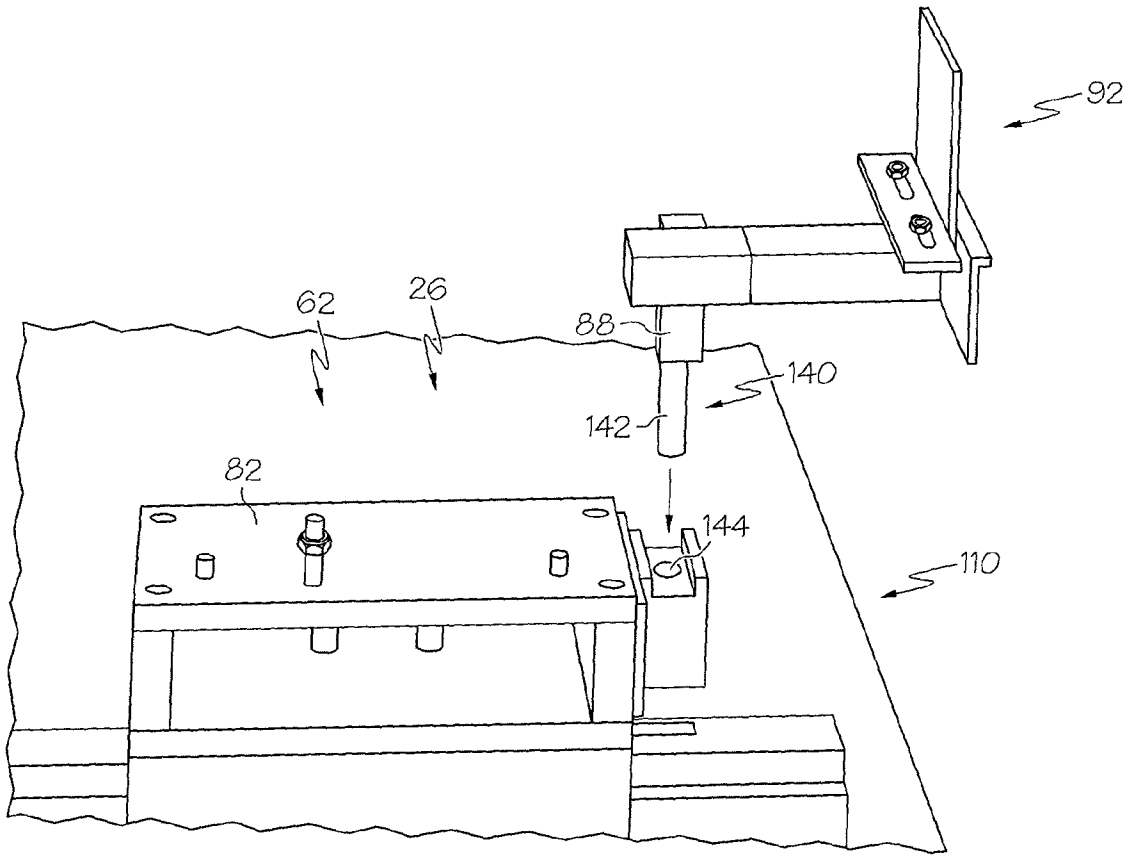
FIG. 6 is a perspective view of another base assembly for use in the split idle station assembly of FIG. 2 according to one or more embodiments described herein.
Figure 7:
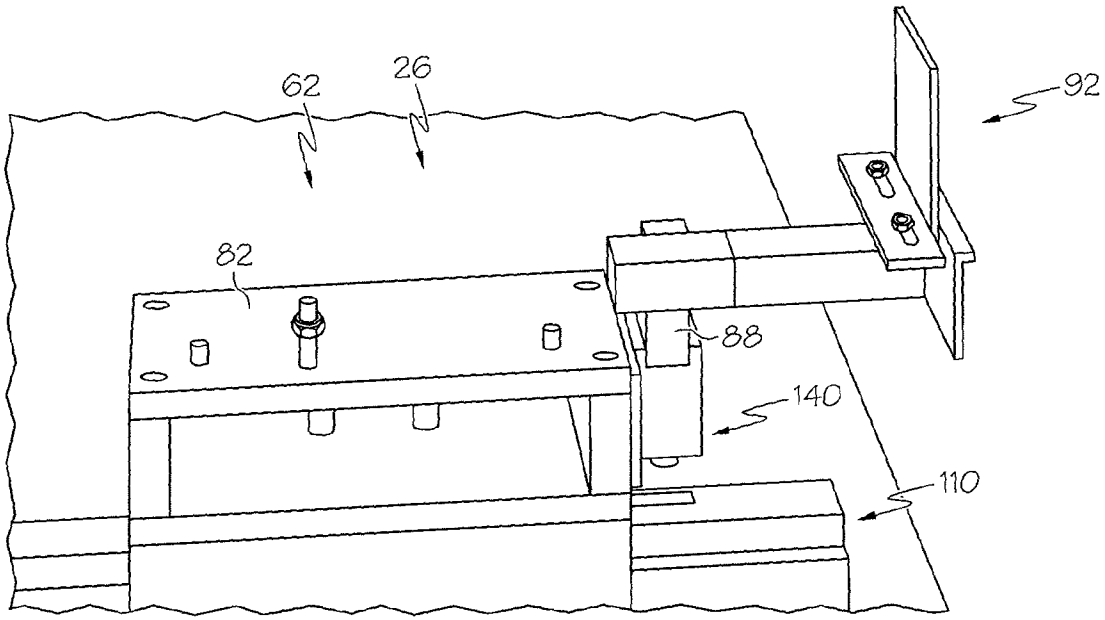
FIG. 7 is another perspective view of the base assembly of FIG. 6.

Referring to FIGS. 6 and 7, the second base assembly 62 is illustrated in its split configuration, near the side 110 of the transfer region 26. As can be seen, the second base assembly 62 may include the upwardly extending support arm 88 which, in this embodiment, is removable from the track support 82. Such a removable arrangement can allow for interchangeability of the work piece support 92 with other work piece supports of other sizes and shapes (e.g., to accommodate work pieces of varying sized and shapes). As above, a removable connection structure 140 may be provided that allows the upward extending support arm 88 to separate from the track support 82. In this embodiment, the removable connection structure 140 includes a pin portion 142 and a slot portion 144 that is sized to receive the pin portion 142 for a mating connection. Any suitable other connection structures may be used.

Figure 8:
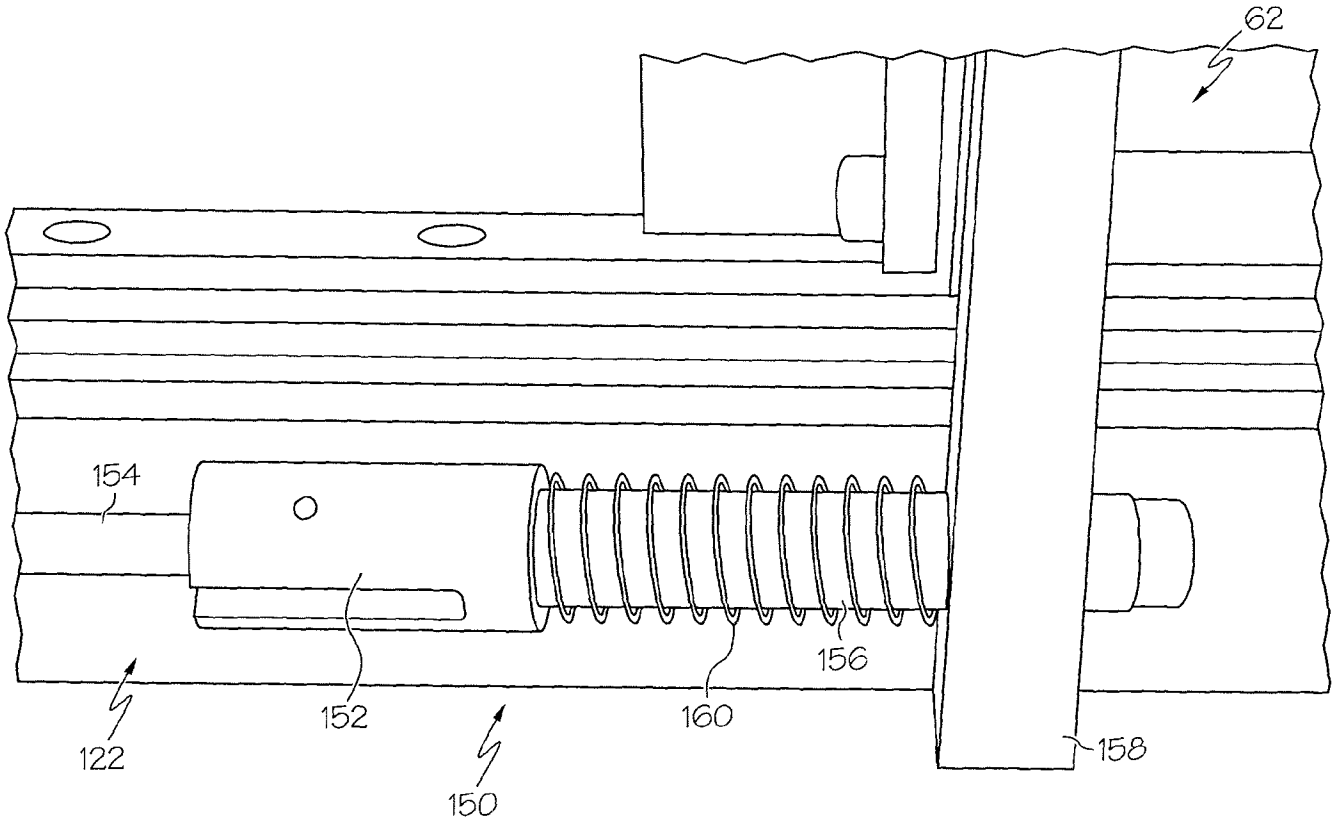
FIG. 8 is a detailed side view of the base assembly of FIG. 6 showing a moveable handle according to one or more embodiments described herein.
Figure 9:
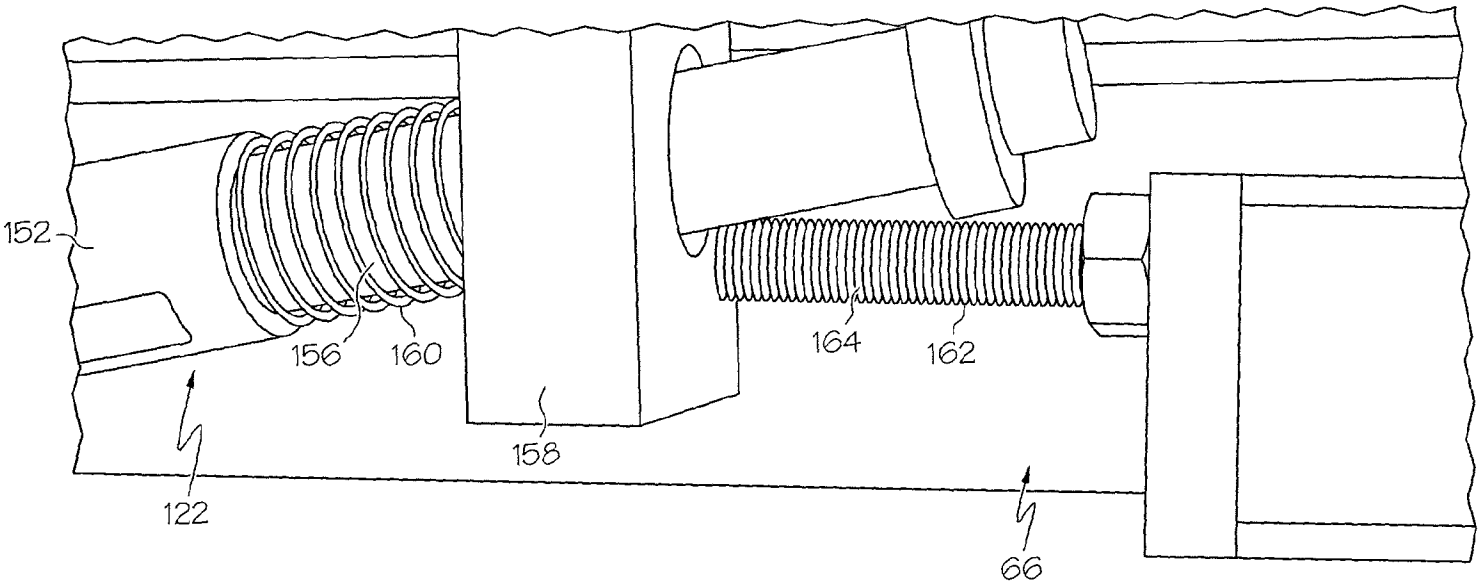
FIG. 9 is another detailed side view of the base assembly of FIG. 8 showing the moveable handle in the support configuration.

Once the work piece supports 78 and 92 are connected to the track supports 72 and 82, the first and second base assemblies 60 and 62 may be moved from their split configuration to their support configuration. As described above, the moveable handle 122 (FIG. 2) may be used to move the first and second base assemblies 60 and 62 from their split configuration to their support configuration. Referring to FIG. 8, the moveable handle 122 may be connected to the second base assembly 62 (or the first base assembly 60) by a spring rod assembly 150. The spring rod assembly 150 may include a rod connector 152 that connects to a guide rod 154 of the moveable handle 122, a connector rod 156 that extends outwardly from the rod connector 152 and is received within an opening extending through a connector plate 158 of the second base assembly 62 and a spring 160 received about the connector rod 156 and located between the rod connector 152 and the connector plate 158. The spring 160 may be provided to allow some movement of the connector rod 156 relative to the connector plate 158 and to bias the second base assembly 62 toward a stop 162 as shown in FIG. 9. Referring to FIG. 9, in the support configuration, the connector plate 158 of the second base assembly 62 may be biased against the stop 162, which is formed by a bolt 164 that is rigidly attached to the track assembly 66. Thus, the first and second base assemblies 62 can be biased in their support configuration (FIG. 2) when the moveable handle 86 is affixed to the track assembly 66.

The above-described split idle station assemblies 32 provide a split configuration having a first base assembly 60 and a second base assembly 62 that can be moved between support configurations and split configurations. In the support configuration, the first base assembly 60 and the second base assembly 62 are move together along a track assembly 66 to form the work piece assembly 64 that supports a work piece thereon. In the split configuration, the first base assembly 60 and the second base assembly 62 may be moved apart and toward opposite sides 106 and 110 of the transfer region 26. The split configuration of the first base assembly 60 and the second base assembly 62 can allow for the interchanging of the work piece supports 78 and 92 with other work piece supports of other sizes and shapes in a more convenient fashion and with more ease to the operator.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A split idle station assembly for a transfer press assembly, comprising:

a track assembly;

a first base assembly slidably connected to the track assembly;

a second base assembly slidably connected to the track assembly; and a drive assembly that moves the first base assembly and the second base assembly between a support configuration and a split configuration;

wherein the first and second base assemblies have the support configuration with the first base assembly adjacent the second base assembly forming a work piece support assembly for supporting a work piece thereon between work stations of the transfer press assembly;

wherein the first and second base assemblies have the split configuration where the first base assembly is moved apart from the second base assembly along the track assembly;

wherein the drive assembly comprises a pulley system comprising a continuous cable having a first leg connected to the first base assembly and a second leg connected to the second base assembly such that movement of either of the first base assembly or the second base assembly moves the other of the first base assembly or the second base assembly along the track assembly.

2. The split idle station assembly of claim 1 further comprising a moveable handle connected to one of the first base assembly and the second base assembly.

3. The split idle station assembly of claim 1, wherein the track assembly comprises a rail along which the first base assembly and the second base assembly move.

4. The split idle station assembly of claim 1, wherein the first base assembly includes a track support that rides along the track assembly and a work piece support supported by the track support that engages the work piece.

5. The split idle station assembly of claim 1, wherein the second base assembly includes a track support that rides along the track assembly including a support surface that supports the work piece thereon and a work piece support supported by the track support that engages the work piece.

6. A transfer press assembly comprising:

a first work station;

a second work station;

a transfer feed assembly that transfers a work piece from the first work station to the second work station; and a split idle station assembly between the first work station and the second work station, the split idle station assembly comprising:

a track assembly;

a first base assembly slidably connected to the track assembly;

a second base assembly slidably connected to the track assembly, wherein the first and second base assemblies have a support configuration with the first base assembly adjacent the second base assembly forming a work piece support assembly for supporting a work piece thereon between work stations of the transfer press assembly, wherein the first and second base assemblies have a split configuration where the first base assembly is moved apart from the second base assembly along the track assembly; and a drive assembly that moves the first base assembly and the second base assembly between the support configuration and the split configuration, wherein the drive assembly comprises a pulley system comprising a continuous cable having a first leg connected to the first base assembly and a second leg connected to the second base assembly such that movement of either of the first base assembly or the second base assembly moves the other of the first base assembly or the second base assembly along the track assembly.

7. The transfer press assembly of claim 6, wherein the split idle station assembly further comprises a moveable handle connected to one of the first base assembly and the second base assembly.

8. The transfer press assembly of claim 6, wherein the track assembly comprises a rail along which the first base assembly and the second base assembly move.

9. The transfer press assembly of claim 6, wherein the first base assembly includes a track support that rides along the track assembly and a work piece support supported by the track support that engages the work piece.

10. The transfer press assembly of claim 6, wherein the second base assembly includes a track support that rides along the track assembly including a support surface that supports the work piece thereon and a work piece support supported by the track support that engages the work piece.

11. A method of providing an idle station for a work piece between work stations of a transfer press assembly, the method comprising:

moving first and second base assemblies along a track assembly to a support configuration with the first base assembly adjacent the second base assembly forming a work piece support assembly for supporting a work piece thereon between the work stations of the transfer press assembly; and moving the first and second base assemblies along the track assembly to a split configuration where the first base assembly is moved apart from the second base assembly along the track assembly;

wherein the steps of moving the first and second base assemblies include moving the first base assembly and the second base assembly between the support configuration and the split configuration using a drive assembly;

wherein the drive assembly comprises a pulley system comprising a continuous cable having a first leg connected to the first base assembly and a second leg connected to the second base assembly such that movement of either of the first base assembly or the second base assembly moves the other of the first base assembly or the second base assembly along the track assembly.

12. The method of claim 11 further comprising moving a moveable handle connected to one of the first base assembly and the second base assembly.

13. The method of claim 11, wherein the track assembly comprises a rail along which the first base assembly and the second base assembly move.

14. The method of claim 11, further comprising engaging a work piece with a work piece support of the first base assembly.

* * * * *